US005888373A

United States Patent [19]

Lin et al.

[11] Patent Number: 5,888,373

[45] Date of Patent: Mar. 30, 1999

[54] METHOD FOR REPAIRING NICKEL-ZINC-COPPER OR NICKEL-ZINC ALLOY ELECTROPLATING SOLUTIONS FROM ACIDIC WASTE SOLUTIONS CONTAINING NICKEL AND ZINC IONS AND ELECTROPLATING THEREOF

[75] Inventors: Jin-Chie Lin; Chih-Chia Chen; Tai-Hong Chen, all of Taoyuan; Fong-Ru Yang; Jyh-Herng Chen, both of Hsinchu, all of Taiwan

[73] Assignee: Industrial Technology Research Institute, Hsinchu, Taiwan

[21] Appl. No.: 880,998

[22] Filed: Jun. 23, 1997

[51] Int. Cl.[6] ..... C25D 3/58

[52] U.S. Cl. ..... 205/240; 205/81; 205/255; 205/245

[58] Field of Search ..... 205/238, 239, 205/240, 243, 244, 245, 246, 255, 81, 82

*Primary Examiner*—Kathryn Gorgoe
*Assistant Examiner*—Thomas H. Parsons
*Attorney, Agent, or Firm*—Bacon & Thomas, PLLC

[57] ABSTRACT

A method for preparing a nickel-zinc-copper or nickel-zinc alloy electroplating solution from at least one electroplating waste solution and/or at least one acidic leach solution of metal scrap containing nickel and/or zinc ions is disclosed. The method involves mixing two or more than two of solutions of the electroplating waste solutions and the acidic leach solutions, and optionally water, so that the ion concentrations of Ni, Zn, Cu, Fe, Cr and Pb of the resulting mixed solution are within the following ion concentrations: 15 $gdm^{-3}<Ni^{2+}<58$ $gdm^{-3}$, 28 $gdm^{-3}<Zn^{2+}<44$ $gdm^{-3}$, $0<Cu^{2+}<1430$ $gm^{-3}$, $0<Fe^{2+}+Fe^{3+<5000gm\ -3}$, $0<Cr^{3+}<1000$ $gm^{-3}$ and $0<Pb^{2+}<50$ $gm^{-3}$.

21 Claims, No Drawings

METHOD FOR REPAIRING NICKEL-ZINC-COPPER OR NICKEL-ZINC ALLOY ELECTROPLATING SOLUTIONS FROM ACIDIC WASTE SOLUTIONS CONTAINING NICKEL AND ZINC IONS AND ELECTROPLATING THEREOF

FIELD OF THE INVENTION

The present invention relates generally to a method for preparing a nickel-zinc-copper or nickel-zinc alloy electroplating solution from an electroplating waste solution and/or an acidic leach solution of metal scrap containing nickel and/or zinc ions.

BACKGROUND OF THE INVENTION

Various methods have been utilized to treat a waste solution containing metallic ions. Ion exchange, membrane separation, solvent extraction, electrowining and precipitation are typical treatments for a waste solution containing a low concentration of metallic ions. As to the treatment of a waste solution containing a high concentration of metallic ions such as an electroplating waste solution and a thick leach solution of metal scrap, a complicated process involving several of those treatments is generally required, and thus the operation cost thereof is relatively high. When the waste solution contains different metallic ions of high concentrations, the separations of metallic ions from the waste solution become more difficult. Therefore, an ideal process for treating the waste solutions should be able to minimize the steps of separations, and preferably recycle useful products therefrom.

Upon electroplating a single metal such as zinc and nickel metal, impurity control in the electroplating bath is severe [C. Cachet, R. Wiart, "Zinc deposition and passivated hydrogen evolution in highly acidic sulphate electrolytes: depassitivation by nickel impurities", Journal of Applied Electrochemistry, 20 (1990), p. 1009–1014.; S. K. Gogia, S. C. Das, "The effect of Co, Cu, Fe and Fe during electrowining of nickel", Journal of Applied Electrochemistry, 21 (1991), p. 64–72]. However, there is no study on the effect of impurities on the newly developed nickel-zinc alloy electroplating [A. Brenner, "Electrodeposition of Alloys", Two Volumes, Academic Press, Inc., New York (1963); R. Shula, S. K. Srivastava, and S. C. Srivastava, "The role of addition agents in the electrobath", Surface and Coating Technology, 28 (1986), p. 129–231].

SUMMARY OF THE INVENTION

It is therefore the primary objective of the present invention to provide a method for preparing a nickel-zinc-copper or nickel-zinc alloy electroplating solution from waste solutions containing zinc and/or nickel ions.

It is still another objective of the present invention to provide a method for electroplating a nickel-zinc or nickel-zinc-copper alloy with the nickel-zinc or nickel-zinc-copper electroplating solution which is prepared by the method of the present invention.

In keeping with the principle of the present invention, the foregoing objectives of the present invention are attained by a method for preparing a nickel-zinc-copper or nickel-zinc alloy electroplating solution from an electroplating waste solution and/or an acidic leach solution of metal scrap containing nickel and/or zinc.

The method of the present invention consists of the following steps of:

(a) measuring ion concentrations of Ni, Zn, Cu, Fe, Cr and Pb in two or more than two solutions selected from the group consisting of an electroplating waste solution containing nickel, an electroplating waste solution containing zinc ions, an electroplating waste solution containing nickel and zinc ions, an acidic leach solution of metal scrap containing nickel ions, an acidic leach solution of metal scrap containing zinc ions, and an acidic leach solution of metal scrap containing nickel and zinc ions; and (b) mixing two or more than two of said measured solutions, and optionally water, so that the ion concentrations of Ni, Zn, Cu, Fe, Cr and Pb of the resulting mixed solution are in conformity with the ion concentrations specified as follows:

$15\ gdm^{-3} < Ni^{2+} < 58\ gdm^{-3}$ $28\ gdm^{-3} < Zn^{2+} < 44\ gdm^{-3}$ $0 < Cu^{2+} < 1430\ gm^{-3}$ $0 < Fe^{2+} + Fe^{3+} < 5000\ gm^{-3}$ $0 < Cr^{3+} < 1000\ gm^{-3}$ $0 < Pb^{2+} < 50\ gm^{-3}$ wherein an electroplating solution suitable for depositing a nickel-zinc alloy is attained as the $Cu^{2+}$ concentration is smaller than 500 $gm^{-3}$; and wherein an electroplating solution suitable for depositing a nickel-zinc-copper alloy is attained as the $Cu^{2+}$ concentration is greater than 500 $gm^{-3}$.

Preferably, the $Ni^{2+}$ concentration specified in the step (b) ranges from 18 to 24 $gdm^{-3}$, the $Zn^{2+}$ concentration specified in the step (b) ranges from 31 to 36 $gdm^{-3}$, and the $Pb^{2+}$ concentration specified in the step (b) is less than 20 $gm^{-3}$.

In addition to the method described above, the present invention discloses further an electroplating method for the nickel-zinc-copper alloy electroplating solution prepared by the method of the present invention. The electroplating method of the present invention consists of electrolysis, in which an article to be electroplated is used as the cathode for carrying out the electrolysis. In the meantime, the nickel-zinc-copper alloy electroplating solution is used as the electrolyte having a pH ranging between 2 and 5, preferably 4. The electrolysis is carried out at a current density ranging between 200 and 500 $Am^{-2}$.

By using the nickel-zinc alloy electroplating solution prepared by the method of the present invention, another electrolysis can be carried out such that an article to be electro deposited is used as the cathode, and that the nickel-zinc alloy electroplating solution is used as the electrolyte. The current density of the electrolysis ranges between 200 and 500 $Am^{-2}$. The pH value of the electrolyte ranges between 2 and 5, preferably 4.

It is recommended that a brightener is added to the electrolyte in the electroplating method of the present invention. The brightener may be glycine, glucose, or ascorbic acid, preferably glycine. The preferred concentration of the brightener added to the electrolyte is about 1000 $gm^{-3}$.

The foregoing objectives, features, functions, and advantages of the present invention will be more readily understood upon a thoughtful deliberation of the following detailed description of the embodiments of the present invention.

DETAILED DESCRIPTION OF THE INVENTION

The present invention discloses a method for preparing a nickel-zinc-copper or nickel-zinc alloy electroplating solution from at least one electroplating waste solution and/or at least one acidic leach solution of metal scrap containing nickel and/or zinc ions.

The electroplating waste solution suitable for use in the method of the present invention can be a nickel electroplating waste solution, for example, a black nickel electroplating waste solution and a Watts nickel electroplating waste solution; a zinc electroplating waste solution; a nickel-zinc alloy electroplating waste solution or a nickel-zinc-copper alloy electroplating waste solution.

The acidic leach solution of the metal scrap is prepared by immersing metal scrap in an aqueous solution of a strong acid such as $H_2SO_4$ and $HNO_3$. The metal scrap may be a post-consuming zinc article having multiple electroplating layers of copper and nickel; a post-consuming zinc article having multiple electroplating layers of copper, nickel and chromium; a waste zinc cast article; secondary scrap of zinc casting in which zinc is previously melted away; used hooks in nickel electroplating; nickel scrap; a waste Raney nickel; and a nickel electrode of a post-consuming nickel hydrogen battery.

The method of the present invention consists of the following steps of:

(a) measuring ion concentrations of Ni, Zn, Cu, Fe, Cr and Pb in said at least one electroplating waste solution and/or said at least one acidic leach solution of the metal scrap; and (b) mixing two or more than two of said measured solutions, and optionally water, so that the ion concentrations of Ni, Zn, Cu, Fe, Cr and Pb of the resulting mixed solution are in conformity with the-ion concentrations specified as follows:

$15\ gdm^{-3}<Ni^{2+}<58\ gdm^{-3}$ $28\ gdm^{-3}<Zn^{2+}<44\ gdm^{-3}$ $0<Cu^{2+}<1430\ gdm^{-3}$ $0<Fe^{2+}+Fe^{3+}<5000\ gdm^{-3}$ $0<Cr^{3+}<1000\ gm^{-3}$ $0<Pb^{2+}<50\ gm^{-3}$ A suitable method for measuring the ion concentrations of Ni, Zn, Cu, Fe, Cr and Pb is ICP-AES (Inductively Coupled Plasma-Atomic Emission Spectrophotometry).

A solution suitable for electroplating a nickel-zinc alloy is attained if the $CU^{2+}$ concentration of the resulting mixed solution is smaller than 500 $gm^{-3}$. On the other hand, if the $Cu^{2+}$ concentration of the resulting mixed solution is greater than 500 $gm^{-3}$, a solution suitable for electroplating the nickel-zinc-copper alloy is obtained.

The electroplating solutions obtained by the method of the present invention may serve as an electrolyte in electrolysis in which an article is electroplated with a Ni—Zn—Cu or Ni—Zi alloy layer. The electrolysis has a current efficiency as high as 90% and over. The electrolysis referred to above can be brought about by a current density ranging between 200 and 500 $Am^{-2}$. In the meantime, the electrolyte (the electroplating solution) of the present invention has a pH value ranging between 2 and 5, preferably 4. It is recommended that a brightener, such as glycine, glucose, or ascorbic acid, be added-to the electrolyte such that the concentration of the brightener is about 1000 $gm^{-3}$. The pH value of the electrolyte of the present invention can be kept in the range of 2–5 by adding an alkali, such as ammonium sulfate. The electroplating layer formed by the present invention is semilustrous and gray. According to the ASTM D 3359 test, both electroplating layers of the present invention have an excellent adhesive quality (0-grade). In addition, both electroplating layers formed by the present invention have a hardness and a corrosive resistance both superior to those of a pure nickel electroplating layer or a pure zinc electroplating layer.

EXAMPLES 1–16

$H_2SO_4$ solutions containing a $Ni^{2+}$ concentration of 22 $gdm^{-3}$ and a $Zn^2$+ concentration of 35 $gdm^{-3}$ and other metal ions having concentrations listed in Table 1 were used as an electroplating bath, and a fixed current density of 200–500 $Am^{-2}$ was used in Ni—Zn alloy electroplating. The $H_2SO_4$ solutions further contained 13.2 $gdm^{-3}$ of ammonium sulfate so that a pH value of 4 was obtained. In addition, glycine was added as a brightener to each of the $H_2SO_4$ solutions so that it had a glycine concentration of 1000 $gm^{-3}$. The results are presented in the following Table 1.

TABLE 1

| | Concentration ($gm^{-3}$) | | | | Current density | Hardness | Corrosive resistance | Current efficien- |
|---|---|---|---|---|---|---|---|---|
| Ex. | Cu | Fe | Cr | Pb | ($Am^{-2}$) | (VHN) | (Ohm) | cy (%) |
| 1 | 100 | 960 | 835 | 18 | 200 | 250 | 260 | 92 |
| 2 | 500 | 985 | 825 | 20 | 300 | 270 | 300 | 93 |
| 3 | 100 | 230 | | 5 | 400 | 290 | 300 | 90 |
| 4 | 50 | | 755 | 11 | 500 | 265 | 315 | 95 |
| 5 | 50 | 100 | | | 200 | 260 | 117 | 94 |
| 6 | 50 | 10 | | | 300 | 263 | 205 | 90 |
| 7 | 50 | 5000 | | | 400 | 250 | 305 | 92 |
| 8 | 50 | 1000 | | | 500 | 290 | 415 | 94 |
| 9 | 50 | | 90 | | 200 | 263 | 120 | 93 |
| 10 | 50 | | 9 | | 300 | 250 | 200 | 94 |
| 11 | 50 | | 900 | | 400 | 320 | 303 | 90 |
| 12 | 50 | | 450 | | 500 | 271 | 450 | 93 |
| 13 | 50 | | | 5 | 200 | 280 | 125 | 90 |
| 14 | 50 | | | 2 | 360 | 261 | 180 | 92 |
| 15 | 50 | | | 20 | 400 | 234 | 301 | 90 |
| 16 | 50 | | | 10 | 500 | 295 | 450 | 91 |
| 17 | 361 | 660 | | 0.3 | 300 | 270 | 300 | 91 |
| 18 | 50 | 4960 | 5 | | 400 | 320 | 305 | 93 |
| 19 | 49 | 145 | 125 | | 300 | 260 | 205 | 93 |

On the basis of the data shown in Table 1, it is readily apparent that the hardness and the corrosive resistance of the electroplating layers of the Examples 1–16 are superior to those of the pure nickel electroplating layer and the pure zinc electroplating layer, which have respectively the hardness 130–200 (VHN) and the hardness 100–170 (VHN). The corrosive resistance of the pure nickel electroplating layer and the pure zinc electroplating layer are 180–250 (Ohm) and 140–180 (Ohm), respectively.

In the following Examples 17–19, the leaching solutions and the electroplating waste solutions listed as follows were used for preparing the Ni—Zn alloy electroplating solutions:

| | Concentration, $gm^{-3}$ | | | | | |
|---|---|---|---|---|---|---|
| Solution* | Ni | Zn | Cu | Fe | Pb | Cr |
| A | 21000 | 22000 | 400 | 730 | | |
| B | 63000 | 7000 | 30 | 150 | | |
| C | 10 | 120000 | 10 | 30 | 3 | |
| D | 112000 | | | 4800 | | |
| E | 30000 | 70000 | 80 | 20 | 250 | |
| F | 300 | 140000 | 260 | 16 | | 20 |

*A: a black nickel electroplating waste solution; B: a Watts nickel electroplating waste solution; C:. a zinc electroplating waste solution; D: a leach solution of Raney nickel; E: a leach solution of a waste zinc cast article; F: a solution leached from secondary scrap of zinc casting

EXAMPLE 17

900 ml of A solution and 100 ml of C solution were mixed such that an electroplating solution containing a zinc ion concentration of 31.8 $gdm^{-3}$, a nickel ion concentration of 18.9 $gdm^{-3}$, a copper ion concentration of 361 $gm^{-3}$, an iron ion concentration of 660 $gm^{-3}$, and a Pb ion concentration of 0.3 $gm^{-3}$ was obtained. To the electroplating solution glycine was added so that the electroplating solution had a glycine concentration of 1000 $gm^{-3}$. The electroplating was carried out at room temperature and with a current density of 300 $Am^{-2}$. The hardness and the corrosive resistance of the nickel-zinc alloy electroplating layer were shown in Table 1 and are superior to those of the electroplating layers of pure zinc and pure nickel.

EXAMPLE 18

200 ml of D solution and 250 ml of E solution were mixed and then diluted by 550 ml of water such that an electroplating solution containing a zinc ion concentration of 35 $gdm^{-3}$, a nickel ion concentration of 22.5 $gdm^{-3}$, a copper ion concentration of 50 $gm^{-3}$, an iron ion concentration of 4960 $gm^{-3}$, and a Cr ion concentration of 5 $gm^{-3}$, was obtained. To the electroplating solution glycine was added so that the electroplating solution has a glycine concentration of 1000 $gm^{-3}$. The electroplating was carried out at room temperature and with a current density of 400 $Am^{-2}$ . The hardness and the corrosive resistance of the nickel-zinc alloy electroplating layer are shown in Table 1 and were superior to those of the electroplating layers of pure zinc and pure nickel.

EXAMPLE 19

300 ml of B solution and 500 ml of E solution were mixed and then diluted with 200 ml of water such that an electroplating solution containing a zinc ion concentration of 35 $gdm^{-3}$, a nickel ion concentration of 19 $gdm^{-3}$, a copper ion concentration of 49 $gm^{-3}$, an iron ion concentration of 145 $gm^{-3}$, and a Cr ion concentration of 12.5 $gm^{-3}$ was obtained. To the electroplating solution glycine was added so that the electroplating solution has a glycine concentration of 1000 $gm^{-3}$. The electroplating was carried out at room temperature and with a current density of 300 $Am^{-2}$. The hardness and the corrosive resistance of the nickel-zinc alloy electroplating layer are shown in Table 1 and were superior to those of the electroplating layers of pure zinc and pure nickel.

What is claimed is:

1. A method for preparing a nickel-zinc-copper or nickel-zinc alloy electroplating solution comprising the following steps:

(a) measuring ion concentrations of Ni, Zn, Cu, Fe, Cr and Pb in two or more than two solutions selected from the group consisting of an electroplating waste solution containing nickel, an electroplating waste solution containing zinc ions, an electroplating waste solution containing nickel and zinc ions, an acidic leach solution of metal scrap containing nickel ions, an acidic leach solution of metal scrap containing zinc ions, and an acidic leach solution of metal scrap containing nickel and zinc ions; and (b) mixing two or more than two of said measured solutions, and optionally water, according to the ion concentrations measured in step (a), so that the ion concentrations of Ni, Zn, Cu, Fe, Cr and Pb of the resulting mixed solution are in conformity with the ion concentrations specified as follows:

$15\ gdm^{-3}<Ni^{2+}<58\ gdm^{-3}$
$28\ gdm^{-3}<Zn^{2+}<44\ gdm^{-3}$
$0<Cu^{2+}<1430\ gm^{-3}$
$0<Fe^{2+}+Fe^{3+}<5000\ gm^{-3}$
$0<Cr^{3+}<1000\ gm^{-3}$
$0<Pb^{2+}<50\ gm^{-3}$ wherein an electroplating solution suitable for depositing a nickel-zinc alloy is attained as the $Cu^{2+}$ concentration is smaller than 500 $gm^{-3}$; and wherein an electroplating solution suitable for depositing a nickel-zinc-copper alloy is attained as the $Cu^{2+}$ concentration is greater than 500 $gm^{-3}$.

2. The method as defined in claim 1, wherein the $Ni^{2+}$ concentration specified in the step (b) ranges from 18 to 24 $gdm^{-3}$, and the $Zn^{2+}$ concentration specified in the step (b) ranges from 31 to 36 $gdm^{-3}$.

3. The method as defined in claim 1, wherein the $Pb^{2+}$ concentration specified in the step (b) is less than 20 $gm^{-3}$.

4. The method as defined in claim 1, wherein said two or more than two solutions measured in the step (a) are selected from the group consisting of a nickel electroplating waste solution, a zinc electroplating waste solution, a nickel-zinc alloy electroplating waste solution, a nickel-zinc-copper alloy electroplating waste solution, and an acidic leach solution of metal scrap containing zinc and/or nickel ions prepared by immersing said metal scrap in an aqueous solution of a strong acid.

5. The method as defined in claim 1, wherein said metal scrap is a post-consuming zinc article having multiple electroplating layers of copper and nickel; a post-consuming zinc article having multiple electroplating layers of copper, nickel and chromium; a waste zinc cast article; secondary scrap of zinc casting in which zinc is previously melted away; used hooks in nickel electroplating; nickel scrap; a waste Raney nickel; and a nickel electrode of a post-consuming nickel hydrogen battery.

6. A method for electroplating a nickel-zinc-copper alloy on an article with the nickel-zinc-copper alloy electroplating solution, said method comprising the following steps:

(a) measuring ion concentrations of Ni, Zn, Cu, Fe, Cr and Pb in two or more than two solutions selected from the group consisting of an electroplating waste solution containing nickel, an electroplating waste solution containing zinc ions, an electroplating waste solution containing nickel and zinc ions, an acidic leach solution of metal scrap containing nickel ions, an acidic leach solution of metal scrap containing zinc ions, and an acidic leach solution of metal scrap containing nickel and zinc ions;

(b) mixing two or more than two of said measured solutions, and optionally water, according to the ion concentrations measured in step (a), so that the ion concentrations of Ni, Zn, Cu, Fe, Cr and Pb of the resulting mixed solution are in conformity with the ion concentrations specified as follows:

$15\ gdm^{-3}<Ni^{2+}<58\ gdm^{-3}$
$28\ gdm^{-3}<Zn^{2+}<44\ gdm^{-3}$
$500\ gm^{-3}<Cu^{2+}<1430\ gm^{-3}$
$0<Fe^{2+}+Fe^{3+}<5000\ gm^{-3}$
$0<Cr^{3+}<1000\ gm^{-3}$
$0<Pb^{2+}<50\ gm^{-3}$; and (c) conducting an electrolysis reaction, in which said article to be electroplated is used as a cathode, the resulting mixed solution from step (b) is used as an electrolyte of said electrolysis reaction, and a current density of 200–500 $Am^{-2}$ is used, wherein said electrolyte has a pH value of 2–5, and where a nickel-zinc-copper alloy layer has been formed on said article.

7. The method as defined in claim 6, wherein the pH value of the electrolyte is 4.

8. The method as defined in claim 6, wherein the electrolyte contains a brightener which is added to the electrolyte.

9. The method as defined in claim 8, wherein the brightener is glycine, glucose, or ascorbic acid.

10. The method as defined in claim 8, wherein the concentration of the brightener is about 1000 $gm^{-3}$.

11. The method as defined in claim 9, wherein the brightener is glycine.

12. The method as defined in claim 6, wherein said two or more than two solutions measured in the step (a) are selected from the group consisting of a nickel electroplating waste solution, a zinc electroplating waste solution, a nickel-zinc alloy electroplating waste solution, a nickel-zinc-copper alloy electroplating waste solution, and an acidic leach solution of metal scrap containing zinc and/or nickel ions prepared by immersing said metal scrap in an aqueous solution of a strong acid.

13. The method as defined in claim 6, wherein said metal scrap is a post-consuming zinc article having multiple electroplating layers of copper and nickel; a post-consuming zinc article having multiple electroplating layers of copper, nickel and chromium; a waste zinc cast article; secondary scrap of zinc casting in which zinc is previously melted away; used hooks in nickel electroplating; nickel scrap; a waste Raney nickel; and a nickel electrode of a post-consuming nickel hydrogen battery.

14. A method for electroplating a nickel-zinc alloy on an article with the nickel-zinc alloy electroplating solution, said method comprising the following steps:

(a) measuring ion concentrations of Ni, Zn, Cu, Fe, Cr and Pb in two or more than two solutions selected from the group consisting of an electroplating waste solution containing nickel, an electroplating waste solution containing zinc ions, an electroplating waste solution containing nickel and zinc ions, an acidic leach solution of metal scrap containing nickel ions, an acidic leach solution of metal scrap containing zinc ions, and an acidic leach solution of metal scrap containing nickel and zinc ions;

(b) mixing two or more than two of said measured solutions, and optionally water, according to the ion concentrations measured in step (a), so that the ion concentrations of Ni, Zn, Cu, Fe, Cr and Pb of the resulting mixed solution are in conformity with the ion concentrations specified as follows:

$15\ gdm^{-3} < Ni^{2+} < 58\ gdm^{-3}$ $28\ gdm^{-3} < Zn^{2+} < 44\ gdm^{-3}$ $0\ gm^{-3} < Cu^{2+} < 500\ gm^{-3}$ $0 < Fe^{2+} + Fe^{3+} < 5000\ gm^{-3}$ $0 < Cr^{3+} < 1000\ gm^{-3}$ $0 < Pb^{2+} < 50\ gm^{-3}$; and (c) conducting an electrolysis reaction, in which said article to be electroplated is used as a cathode, the resulting mixed solution from step (b) is used as an electrolyte of said electrolysis reaction, and a current density of 200–500 $Am^{-2}$ is used, wherein said electrolyte has a pH value of 2–5, and where a nickel-zinc alloy layer has been formed on said article.

15. The method as defined in claim 14, wherein the pH value of the electrolyte is 4.

16. The method as defined in claim 14, wherein the electrolyte contains a brightener which is added to the electrolyte.

17. The method as defined in claim 16, wherein the brightener is glycine, glucose, or ascorbic acid.

18. The method as defined in claim 16, wherein the concentration of the brightener contained in the electrolyte is about 1000 $gm^{-3}$.

19. The method as defined in claim 17, wherein the brightener is glycine.

20. The method as defined in claim 14, wherein said two or more than two solutions measured in the step (a) are selected from the group consisting of a nickel electroplating waste solution, a zinc electroplating waste solution, a nickel-zinc alloy electroplating waste solution, a nickel-zinc-copper alloy electroplating waste solution, and an acidic leach solution of metal scrap containing zinc and/or nickel ions prepared by immersing said metal scrap in an aqueous solution of a strong acid.

21. The method as defined in claim 14, wherein said metal scrap is a post-consuming zinc article having multiple electroplating layers of copper and nickel; a post-consuming zinc article having multiple electroplating layers of copper, nickel and chromium; a waste zinc cast article; secondary scrap of zinc casting in which zinc is previously melted away; used hooks in nickel electroplating; nickel scrap; a waste Raney nickel; and a nickel electrode of a post-consuming nickel hydrogen battery.

* * * * *